US005230135A

United States Patent [19]

Kuehl

[11] Patent Number: 5,230,135

[45] Date of Patent: Jul. 27, 1993

[54] TOP BAR FOR CARDING MACHINE

[75] Inventor: Hans Kuehl, Plochingen, Fed. Rep. of Germany

[73] Assignee: Schubert & Salzer Maschinenfabrik AG, Ingolstadt, Fed. Rep. of Germany

[21] Appl. No.: 737,798

[22] Filed: Jul. 25, 1991

Related U.S. Application Data

[60] Continuation of Ser. No. 579,233, Sep. 5, 1990, abandoned, which is a continuation of Ser. No. 334,809, Apr. 6, 1989, abandoned, which is a division of Ser. No. 86,238, Aug. 14, 1987, Pat. No. 4,827,573, which is a continuation-in-part of Ser. No. 828,225, Feb. 10, 1986, abandoned.

[30] Foreign Application Priority Data

Feb. 15, 1985 [DE] Fed. Rep. of Germany ..... 3505254

[51] Int. Cl.[5] ..... B23P 25/00

[52] U.S. Cl. ..... 29/458; 29/527.4; 72/286; 72/367; 228/151; 228/156

[58] Field of Search ..... 19/102, 110, 111, 113, 19/114; 29/458, 460, 527.1, 527.2, 527.4; 72/53, 286, 367; 228/150, 151, 156

[56] References Cited

U.S. PATENT DOCUMENTS

| | | | |
|---|---|---|---|
| 2,001,643 | 5/1935 | Wilcox | 72/286 X |
| 2,097,254 | 10/1937 | Platt | 19/113 |
| 4,162,559 | 7/1979 | Stewart | 19/113 |
| 4,299,348 | 11/1981 | Fukumoto | 228/156 X |

FOREIGN PATENT DOCUMENTS

| | | | |
|---|---|---|---|
| 384195 | 10/1922 | Fed. Rep. of Germany | 19/113 |
| 409319 | 10/1940 | Fed. Rep. of Germany | 19/113 |

*Primary Examiner*—Joseph M. Gorski
*Attorney, Agent, or Firm*—Dority & Manning

[57] ABSTRACT

A top bar for carding machines formed from an elongated hollow cold drawn annealed profile. The annealing relieves any stresses developed in the profile during the cold drawing and a dimensionally stable top bar results therefrom.

13 Claims, 2 Drawing Sheets

TOP BAR FOR CARDING MACHINE

This application is a continuation of U.S. application Ser. No. 07/579,233, filed on Sep. 5, 1990 and now abandoned, which is a continuation of U.S. application Ser. No. 07/334,809, filed on Apr. 6, 1989 and now abandoned, which is a division of U.S. application Ser. No. 07/086,238, filed on Aug. 14, 1987 and now U.S. Pat. No. 4,827,573, which is a continuation-in-part of U.S. application Ser. No. 06/828,225, filed on Feb. 10, 1986 and now abandonment.

BACKGROUND OF THE INVENTION

This invention relates to a process for producing a top bar for carding machines, which comprise a hollow profile formed by cold drawing and shaping a sheet of metal. The bar has a clothing receiving surface and a back part raised in the form of a T-cross section relative to the clothing receiving surface.

In the past, top bars have been produced from cast iron and have a T-shaped cross section for reinforcement or stiffening. Such bars are heavy and sag under their own weight, especially on very wide carding machine. This sagging causes an impairment of the carding action. Furthermore, the flat drive on revolving flat cards is subjected to undue loads as a result of the heavy weight of the cast iron top bars.

There have also been attempts to produce top bars from hollow profiles such as those shown in German patent specification no. 384,195 and in German Patent No. 409,319. In each of these references, hollow profiles of a T-shaped cross section or of a triangular cross section are produced by bending a sheet of steel into the finished position or final shape and closing the seam of the profile by welding. This procedure is very expensive and also has the disadvantage that the bending results in a less than uniform dimensions with thermo-stresses therein as a result of the later welding operation. Latent stresses and the like imparted to the sheet by the bending step may also cause the bar to be less rigid or to even change its configuration during usage. This problem is accentuated when long top bars are produced for the very wide cards in usage today.

The width of the new cards require very precise dimensions wherein a rigid top bar measuring over one meter in length has the necessary rigidity to provide the necessary surface for supporting the card clothing thereon. It is very important that the top bar be very rigid and present an even surface throughout its length for the support of the card clothing. The reason for this is that the clothing on the top bar must cooperate with the clothing on a card cylinder during the carding operation. The clothing on the card cylinder is ground to a perfectly uniform height throughout its length and the clothing on the top bar must also present a uniform surface throughout its length. If the top bar is permitted to sag due to the weight of the bar or a lack of sufficient rigidity therein, the carding process will be defective at the points that the top bar sags and insufficient carding of the fibers will be obtained.

SUMMARY OF THE INVENTION

In accordance with the present invention, a top bar for a carding machine is provided which comprises a hollow profile which is shaped into the desired configuration by means of a plurality of cold drawing steps utilizing a die and mandrel for drawing a sheet tube into the predetermined hollow configuration.

It is an object of the present invention to provide a top bar of a hollow profile which has precise dimensions throughout its length.

It is another object of the present invention to provide a top bar for a carding machine which is formed by cold drawing and which does not have latent stresses therein.

According to the present invention, the objects are achieved by taking a pipe which may be seamless (or may have been formed by welding) and cold drawing the pipe through a plurality of dies and mandrels or cores in a plurality of cold drawing steps to obtain the predetermined hollow profile. After the welding step where the pipe is formed from a sheet of steel, and after each cold drawing step, the pipe and resulting profile is subjected to an annealing process for relieving the molecular strains or stresses imparted thereto by the welding of the pipe or by the cold drawing and shaping processes. The drawing and the shaping processes produce a precisely dimensioned profile which is free of stresses and possesses the degree of rigidity necessary to support clothing across the wide width of the card.

After the profile is formed and shaped, it is cut into the proper length and card clothing is provided to a predetermined clothing supporting surface. The clothing supporting surface may be sandblasted and coated with a synthetic resin before or after cutting, and before the card clothing is attached thereto.

As a result of this process, a top bar of high rigidity is achieved wherein its back part is formed with two longitudinal walls comprising a rectangular part which tapers, in the form of a roof to an end opposite the side on which the card clothing is supported. As a result of this process, the top bar can be kept narrower than has hitherto been possible, for reasons of rigidity, and the number of top bars utilized on the card can be increased. This greatly improves the carding result. Advantageously, the height of the rectangular part of a top bar and the height of the tapering part of the top bar are selected so that they are in a ratio of approximately 1:1. The rigidity of the top bar is improved even more if the width of the rectangular part is approximately one half to three fourths of the width of the clothing receiving card.

Where a welded pipe is used to form the profile, the seam is not visible after the drawing and shaping processes and the annealing has produced the desired profile.

A secure fastening of the clothing to the top by means of so-called "clips" is achieved by the clothing receiving part having clothing-clip retaining surfaces which extend obliquely inward and which connect the clothing receiving part to the back part. It has been shown that, as regards the load exerted on the top bar as a result of its own weight and the carding work, it is particularly favorable if the ratio between the height and the width of the top bar is in the range of 2:1 to 4:1.

Sheet steel is preferred as the material for the hollow profile, since it has a high modulus of elasticity and its coefficient of thermal expansion corresponds to that of the carding machine. A further reduction in the weight, with the rigidity of the top bar still being sufficiently high in the longitudinal and transverse directions, is achieved by the thickness of the sheet being from 1 to 3 mm. To obtain a plane receiving surface for the clothing, the underside of the clothing receiving part is coated with a synthetic resin. The interior of the hollow profile is filled with foamed material for vibration damping and insulation against noise.

BRIEF DESCRIPTION OF THE DRAWINGS

In order that the invention may be better understood, an embodiment thereof will now be described, by way of example only with reference to the drawings in which.

DETAILED DESCRIPTION OF THE DRAWINGS

Figure 1:
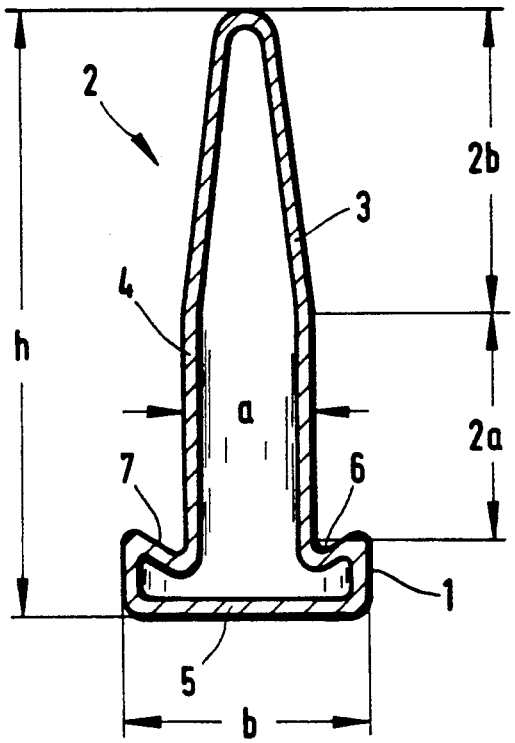
FIG. 1 represents a transverse cross-sectional view through a profile for use as a top bar according to the invention.

FIG. 1 illustrates in cross-section a top bar which is designed as a hollow profile and which is produced integrally from a tubular piece of material. The tubular piece of material, preferably of consisting of sheet steel has been brought to the cross-section illustrated by means of a cold drawing and shaping process. The tubular pieces of material may be either seamless or a tube having a welded seam can also be used.

When a tube having a welded seam is used, the process of preparing the profile comprises the steps of rolling a sheet of steel into a pipe, welding the pipe, annealing the welded pipe to remove latent tensions or stresses developed in the pipe by welding. The pipe, whether it be a seamless pipe or a welded pipe, prepared as noted, is then gripped by means of a collet chuck and the pipe is cold drawn through a die and a mandrel or core. The drawing and shaping of the pipe involves a plurality of individual drawing operations until the predetermined hollow profile is obtained. After each of the cold drawing and shaping steps in the process, the shaped pipe is soft annealed to remove molecular distortions or stresses created by the cold drawing and shaping process steps. Therefore, after the cold drawing and shaping process is complete, a profile of uniform dimensions from one end to the other is obtained which does not have latent molecular distortions or stresses therein. The profile produced by this process is then cut to the desired length, which length may be in excess of one meter without significant deviations from the predetermined dimensions. This process produces a very uniform profile and one that does not contain latent stresses or other distortions which would cause the profile to fail to retain its dimensions during use.

The top bar comprises a clothing receiving part 1 and a back part 2 which adjoins the latter and which is formed from longitudinal walls 3 and 4. The longitudinal walls 3 and 4 are parallel to one another and form a rectangular part 2*a* which then tapers in the form of a roof toward the free end. At the same time, the height of the rectangular part 2*a* and the height of the tapered part 2*b* tapering in the form of a roof are preferably in the ratio of approximately 1:1. According to previous knowledge, a sufficiently high rigidity, even in the case of very long top bars, is obtained if the width a of the rectangular part 2*a* is approximately ½ to ¾ of the width b of the clothing receiving part 1. The sheet thickness is 1 to 3 mm, preferably 2 mm, while the ratio between the height h and the width b of the top bar 1 is in the range of 2:1 to 4:1. The profile shape illustrated is preferred, since it gives the top bar high stability with a small width. The interior of the hollow profile may be appropriately filled with foam for vibration damping and insulation against noise.

To obtain an absolutely plane surface for supporting the clothing, the underside 5 of the clothing receiving part 1 is sandblasted and then coated with a synthetic resin. Fastening of the clothing to the clothing receiving part 1 may be performed in any way, for example by means of the conventional fastening clips or a screw connection. To clamp the clothing securely by means of clips, the clothing receiving part 1 has retaining surfaces 6 and 7 extending obliquely inward for the clips. These retaining surfaces connect the clothing receiving part 1 to the back part 2.

The top bar according to the invention can be used both as a revolving flat and as a fixed carding element. When used as a revolving flat, it guarantees quiet running.

Figure 2:
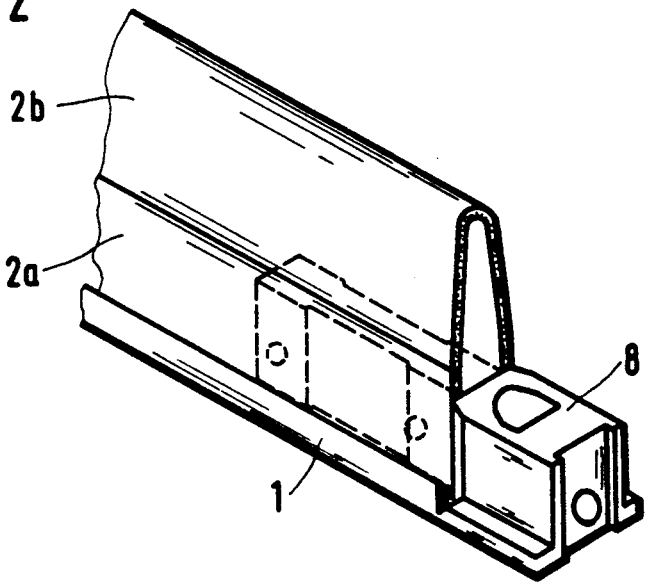
FIG. 2 is a perspective view of a portion of the profile of FIG. 1 with a head piece attached.
Figure 3:
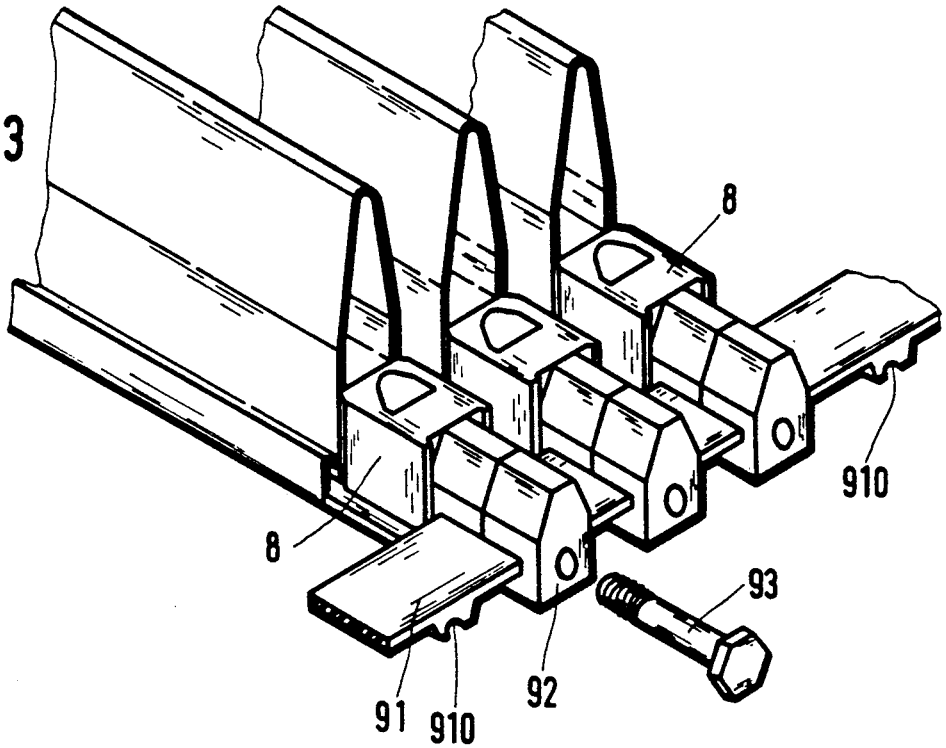
FIG. 3 is a perspective view of a portion of a card flat set utilizing the profile illustrated in FIG. 1.
Figure 4:
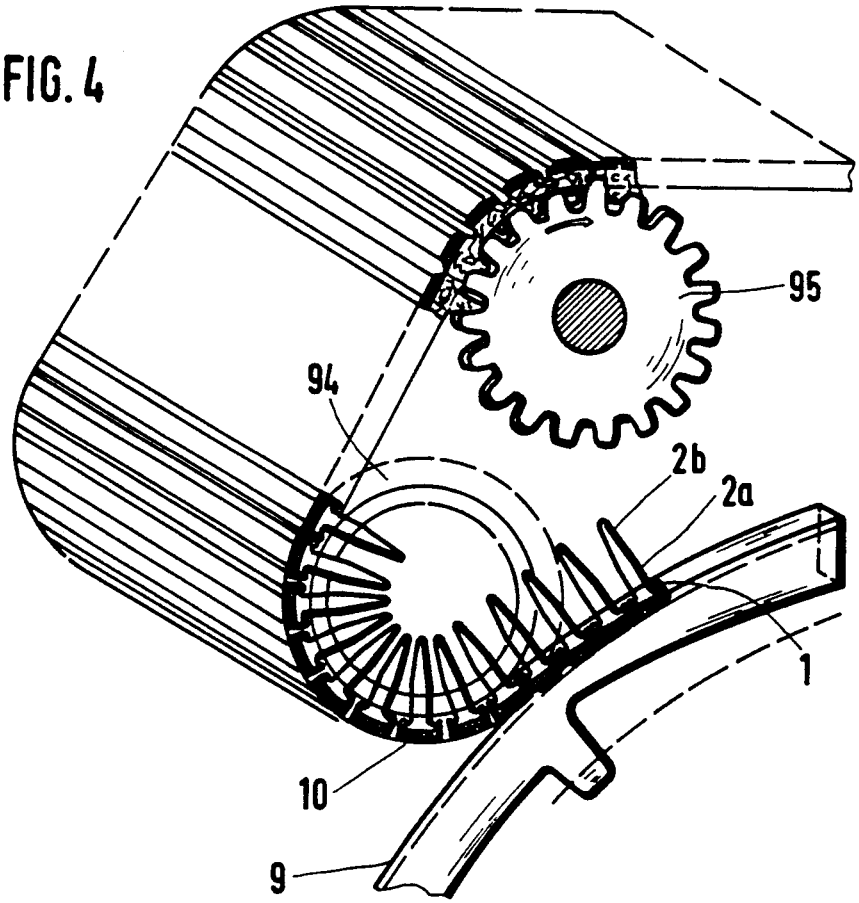
FIG. 4 is a partial perspective view of a carding machine utilizing the top bar of the invention.

An example of the profile's use in revolving flats is shown in FIGS. 2, 3 and 4. As seen in FIGS. 2 and 3, head pieces 8 are inserted into the hollow profile of the top bar at each end. During the operation of the flats, the head pieces 8 are guided on guide surfaces 9 as seen in FIG. 4, arranged in a manner known in the art of manufacturing carding machines.

The head pieces 8 have a height which is not greater than the height of the rectangular part 2*a* of the hollow profile and they extend into the interior of the hollow profile for a limited and relatively short length. This construction enables the manufacture of the head pieces in a simple and economical manner. Furthermore, it guarantees that the head pieces 8 increase the weight of the top bar only by an insignificant amount. Head pieces 8 can be welded to the top bar or can be detachably fastened to it, for example, by screws or rivets so that head pieces 8 may be replaced in case of wear. The resulting top bar has such a high stability that it is not necessary to strengthen the top bar by having head pieces which extend the whole length of the top bar due to the construction process for forming and shaping the tubular profile.

The top bars 1 are driven by flexible endless drive means such as by belts 91 which are provided with profiles 910 which serve as tappets. The belts 91 are arranged on both sides or ends of the top bars and are clamped in holders 92 which are fastened to the head pieces 8 by means of screws 93.

The profiles or tappets 910 receiving the holders 92, and securing its position on the belts 91, are distributed over the length of the endless belts 91 at predetermined equal distances corresponding to the space provided between the top bars or flats. Such space can be very small due to the construction of the top bar or flat so that the number of top bars can be increased over that which is usually used in revolving flat cards.

In operation, the top bars are arranged in endless rows, one after the other, and guided by guide rollers which are driven continuously by drive gears 95 which in turn engage holders 92 of the belt 91. Thereby, the head pieces 8 are guided over the sliding guide 9 and the card clothing 10, which is fastened to the clothing receiving part 1 of the flat, cooperates with the card clothing fixed on the surface of the card cylinder whereby a uniform carding effect is exerted on the fibers carried by the card cylinder throughout the length of the top bar or flat.

Since the construction of the top bar or flat in accordance with the invention permits an increase in a number of flats which can be utilized on a given card, a greater number of flats cooperate with the clothing on the card cylinder to give a better carding effect.

It is to be understood that hereinbefore an example of the top bar has been described and illustrated but that other shapes and profiles could be used equally well without departing from the scope of the appended claims.

What is claimed:

1. A process for producing a hollow unitary carding machine top bar having and a strength and stability enhancing profile, the process comprising the steps of:

forming a sheet of steel having longitudinal edges and a thickness of from 1 to 3 millimeters into a pipe such that said longitudinal edges oppose each other and define a space therebetween;

welding the pipe along said longitudinal edges, thereby sealing said space and producing a welded pipe;

annealing the welded pipe thereby relieving stresses imparted thereto during said welding step;

uniformly cold drawing the welded pipe through a series of uniform dies and core shaping means in a plurality of individual cold drawing steps thereby shaping the pipe into a T-shaped top bar having a generally rectangular card clothing receiving portion having a flat surface and a back portion having two walls with each wall having a first portion extending at a right angle to the clothing receiving portion and parallel to each other, the first portions being spaced apart from each other from ½ to ¾ of a corresponding width of the flat surface of the rectangular card clothing receiving portion, each said walls also having a second portion extending from the first portion, with said second portions converging toward each other and forming a tapered free end portion, wherein the ratio between the height of the first portion and the height of the second portion is approximately 1:1 and wherein the ratio between the distance from the flat surface to the end of the free end portion and the width of the flat surface is from 2:1 to 4:1;

soft annealing the pipe after each of the several individual drawing steps thereby relieving stress imparted thereto during the drawing steps; and cutting the T-shaped top bar to a desired length.

2. The process as set forth in claim 1, including the step of sandblasting the card clothing receiving portion after said drawing steps are completed thereby preparing it for receiving card clothing.

3. The process as set forth in claim 2, including the step of coating the sandblasted card clothing receiving portion with a synthetic resin.

4. The process as set forth in claim 1, including the additional step of inserting a head piece having a sliding surface into each end of the cut T-shaped top bar and attaching the head pieces to the cut T-shaped top bar.

5. A process for producing a hollow unitary carding machine top bar having a strength and stability enhancing profile, the process comprising the steps of:

selecting a hollow steel pipe;

clamping one end of the steel pipe in a collet chuck;

uniformly cold drawing the pipe through a series of uniform dies and core shaping means by means of the collet chuck in a plurality of individual cold drawing steps thereby shaping the pipe into a T-shaped top bar having a generally rectangular card clothing receiving portion having a flat surface and a back portion having two walls with each wall having a first portion extending at a right angle to the clothing receiving portion and parallel to each other, the first portions being spaced apart from each other from ½ to ¾ of a corresponding width of the flat surface of the rectangular card clothing receiving portion, each said walls also having a second portion extending from the first portion, with said second portions converging toward each other and forming a tapered free end portion, wherein the ratio between the height of the first portion and the height of the second portion is approximately 1:1 and wherein the ratio between the distance from the flat surface to the end of the free end portion and the width of the flat surface is from 2:1 to 4:1;

soft annealing the pipe after each of the several individual drawing steps thereby relieving stress imparted thereto during the drawing steps; and cutting the T-shaped top bar to a desired length.

6. The process as set forth in claim 5, including the step of sandblasting the card clothing receiving portion after said drawing steps are completed thereby preparing it for receiving card clothing.

7. The process as set forth in claim 6, including the step of coating the sandblasted card clothing receiving portion with a synthetic resin.

8. The process as set forth in claim 5, including the additional step of inserting a head piece having a sliding surface into each end of the cut T-shaped top bar and attaching the head pieces to the cut T-shaped top bar.

9. The process as set forth in claim 5, including the additional step of annealing the hollow steel pipe prior to said drawing process thereby relieving stresses imparted thereto during said drawing steps.

10. A process for producing a hollow unitary carding machine top bar having a strength and stability enhancing profile, the process comprising the steps of:

selecting a hollow steel pipe;

annealing the hollow steel pipe thereby relieving stresses imparted thereto during further manufacturing steps;

clamping one end of the hollow steel pipe in a collet chuck;

shaping the hollow steel pipe in the following steps;

uniformly cold drawing the hollow steel pipe through a first die and core shaping means, thereby giving it a uniform cross sectional area through substantially its entire length;

soft annealing the cold drawn pipe thereby relieving stresses imparted thereto by said cold drawing;

uniformly cold drawing the soft annealed cold drawn pipe through a second die and core shaping means thereby shaping it into a T-shaped to bar having a generally rectangular card clothing receiving portion having a flat surface and a back portion having two walls, with each wall having a first portion extending at a right angle to the clothing receiving portion and parallel to each other, the first portions being spaced apart from each other from ½ to ¾ of a corresponding width of the flat surface of the card clothing receiving portion, each said walls also having a second portion extending from the first portion, with said second portions converging toward each other and forming a tapered free end portion, wherein the ratio between the height of the first portion and the height of the second portion is approximately 1:1 and wherein the ratio between the distance from the flat surface to the end of the free end portion and the width of the flat surface is from 2:1 to 4:1;

soft annealing the T-shaped top bar, thereby relieving stress imparted thereto during the cold drawing steps; and cutting the T-shaped top bar to a desired length.

11. The process as set forth in claim 10, including the step of sandblasting the card clothing receiving portion after said drawing steps are completed thereby preparing it for receiving card clothing.

12. The process as set forth in claim 11, including the step of coating the sandblasted card clothing receiving portion with a synthetic resin.

13. The process as set forth in claim 10, including the additional step of inserting a head piece having a sliding surface into each end of the cut T-shaped top bar and attaching the head pieces to the cut T-shaped top bar.

* * * * *